United States Patent [19]

Flatt

[11] 4,131,329

[45] Dec. 26, 1978

[54] CURRENT INTERCHANGE FOR A GAS ACTUATED BUSHING

[75] Inventor: Richard P. Flatt, Oconomowoc, Wis.

[73] Assignee: RTE Corporation, Waukesha, Wis.

[21] Appl. No.: 740,376

[22] Filed: Nov. 10, 1976

[51] Int. Cl.[2] ..... H01R 13/52

[52] U.S. Cl. ..... 339/111; 200/144 C; 200/149 A; 339/101; 339/117 R; 339/143 R

[58] Field of Search ..... 200/144 C, 149 A, 151; 339/111, 45, 46, 60 R, 60 C, 94 R, 94 C, 101, 117 R, 143 R

[56] References Cited

U.S. PATENT DOCUMENTS

| | | | |
|---|---|---|---|
| 3,587,035 | 6/1971 | Kotski | 339/143 R X |
| 3,945,699 | 3/1976 | Westrom | 339/111 X |

*Primary Examiner*—Roy Lake
*Assistant Examiner*—DeWalden W. Jones
*Attorney, Agent, or Firm*—Ronald E. Barry

[57] ABSTRACT

A high voltage bushing for an electrical device such as a transformer, the bushing including a fixed cylindrical conductor and a gas actuated bore contact mounted for reciprocal movement in the conductor and a fixed current interchange device in the form of an annular spring mounted in the conductor for maintaining electrical communication between the bore contact and the conductor.

16 Claims, 2 Drawing Figures

CURRENT INTERCHANGE FOR A GAS ACTUATED BUSHING

BACKGROUND OF THE INVENTION

In gas actuated high voltage bushings of the type shown in the Kotski U.S. Pat. No. 3,587,035 entitled "Gas Shield for Load Break Cable Terminator", issued June 22, 1971, the bore contact is moved into engagement with the rod contact by the expansion of gases generated by the heat of the arc which acts upon a piston provided within the bushing. The piston is provided with an annular groove in which a current interchange device in the form of a compression spring is provided that slidably engages the stationary contact within the bushing housing. In this type of a contact, the entire mass of the piston and the contact-snuffer assembly must be moved by the energy produced on expansion of the gases within the bushing housing.

SUMMARY OF THE INVENTION

The high voltage bushing of the present invention reduces the mass of the moving parts which enables the contact-snuffer assembly to move more rapidly and under less gas pressure into engagement with the rod contact. This is accomplished by providing a fixed ring type current interchange element on the inside surface of the fixed contact within the bushing housing. The outer surface of the bore contact is movable within the current interchange element thereby allowing for a reduction in the size of the piston head and thus less mass.

DRAWINGS

Figure 1:
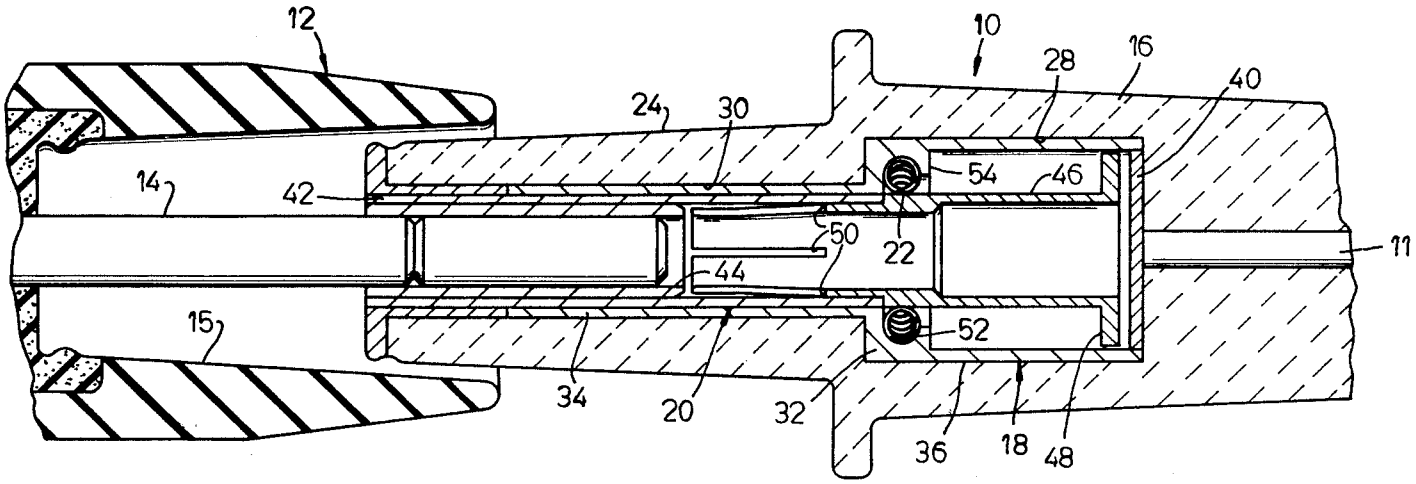
Figure 2:
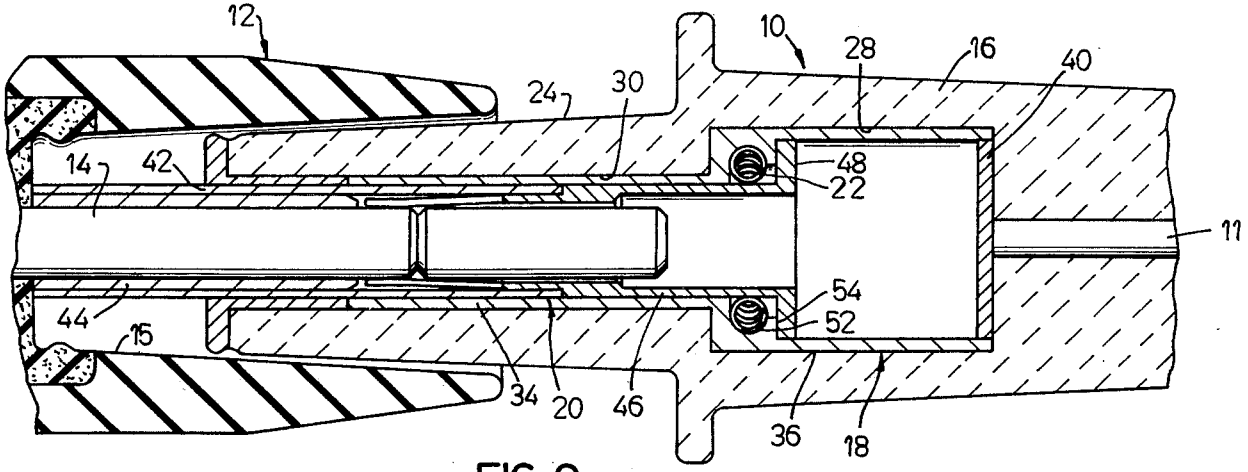

FIG. 1 is a side view in section of the bushing showing the fixed current interchange element according to the invention; and FIG. 2 is a similar side view of the bushing showing the bore contact moved to the gas actuated position.

DESCRIPTION OF THE INVENTION

Referring to the drawing, the high voltage bushing 10 according to the invention is generally used to connect a conductor 11 to a terminator 12 having a probe or rod contact 14 mounted within a tapered recess 15. The bushing 10 includes a housing 16 having a fixed or stationary contact assembly 18 provided within the housing and a contact-snuffer assembly 20 mounted for axial movement in the fixed contact assembly 18. Electrical communication between the fixed contact assembly 18 and the contact-snuffer assembly 20 is provided by means of a fixed current interchange element 22.

More particularly, the bushing housing 16 is formed or molded from a dielectric material and includes a tapered section 24 for matingly engaging the tapered recess 15 in the terminator 12. An enlarged bore or cavity 28 is provided in one end of the housing and a small bore 30 is provided in the other end of the housing which terminates in the large bore or cavity 28. Means are provided in the cavity 28 for electrically connecting the bushing to an electrical device. Such means is in the form of the fixed contact assembly 18 which is connected to the conductor 11 provided in the end of the housing.

The fixed contact assembly 18 includes an electrically conductive tubular member 32 having a reduced diameter section 34 positioned in bore 30 and an enlarged diameter section 36 positioned in the cavity or bore 28.

The member 32 is electrically connected to the electrical conductor 11 by an electrically conductive end plate 40.

The contact-snuffer assembly 20 includes an insulating sleeve 42, an arc-interrupting cylinder 44 and a bore contact 46. The arc-interrupting cylinder 44 is positioned in one end of the sleeve 42. The bore contact 46 extends beyond the other end of the sleeve 42 into the bore or cavity 28 in the housing 16.

Means are provided on the bore contact 46 to form a piston head. Such means is in the form of a flange 48 provided around the end of the bore contact adjacent the plate 40. The flange 48 has an outer diameter smaller than the inner diameter of the enlarged section 36 of the tubular member 32. As is generally described in the Kotski patent, gases generated in cylinder 44 are confined in the bushing by the sleeve 42 and flow through slots 50 provided in the bore contact 46 into the space between the flange 48 and the end plate 40. The gases confined in this space expand to force the contact-snuffer assembly 20 outwardly from the bushing housing and into electrical contact with the probe 14 of the terminator 12.

In accordance with the invention, electrical communication between the fixed contact assembly 18 and the bore contact 46 is maintained by means of the current interchange element 22. In this regard, the current interchange element 22 is positioned within an annular groove 52 provided in the tubular member 32 at the junction of the small diameter section 34 with the large diameter section 36. The element 22 is in the form of an annular ring defined by a compression spring having an inside diameter slightly smaller than the outside diameter of the contact 46. The element 22 is protected from the flange 48 by a limit stop or flange 54 provided in the enlarged diameter section 36 of the cylinder 32.

In operation, the terminator 12 is normally positioned on the bushing 10 by inserting the probe 14 into the contact-snuffer assembly 20. Under normal current conditions the probe is merely pushed into the contact-snuffer assembly 20 until the tapered recess 15 in the terminator seats on the tapered section 24 with the probe 14 in electrical contact with the bore contact 46.

In the event a fault current condition exists in the line, on insertion of the probe 14 into the contact-snuffer assembly 20, the prestrike arc will be of sufficient magnitude to generate gas from the sleeve 44 which will pass through the slots 50 into the cavity 28 and will expand in the space between the flange 48 and the end plate 40. The expanding gases will cause the contact-snuffer assembly 20 to be moved outwardly from the bushing until the flange 48 engages the stop 54. On movement of the bore contact through the annular spring ring 22, continuous communication will be maintained by the engagement of the spring with the outside surface of the bore contact. Since the spring 22 has an inside diameter slightly smaller than the diameter of the bore contact, the inherent bias of the spring will maintain contact with the bore contact.

I claim:

1. An electrical connection comprising: a housing, an electrically conductive member extending through said housing, means for supporting said member in a fixed position in said housing, a bore contact mounted in said housing for reciprocal movement relative to said conductive member, and current interchange means electrically connected to and mounted on said conductive member in a position to encircle said bore contact and having an inside diameter smaller than the diameter of said bore contact for maintaining electrical communication between the outside surface of said bore contact and said conductive member.

2. The connector according to claim 1 wherein said supporting means comprises a bushing housing, said conductive member comprises a cylinder conductor and said contact comprises a gas actuated bore contact mounted within said cylindrical conductor.

3. The connector according to claim 2 wherein said current interchange means comprises a compression spring.

4. The connector according to claim 2 wherein said current interchange means comprises an annular compression spring.

5. The connector according to claim 2 wherein said cylindrical conductor includes means for limiting the movement of said contact.

6. In a gas actuated high voltage bushing having an electrically conductive member mounted therein and a bore contact-arc-snuffer assembly mounted in the bushing for movement relative to the conductive member into engagement with a probe in a terminator in response to the expansion of arc generated gases within the bushing, means for maintaining electrical communication with the bore contact comprising a current interchange element mounted on the conductive member in the bushing in a fixed position and having an inside diameter smaller than the outside diameter of the bore contact to maintain electrical communication with the outside surface of the bore contact on movement of the bore contact relative to the conductive member in the bushing.

7. The bushing according to claim 6 wherein said member is a compression spring.

8. The bushing according to claim 6 wherein said member is an annular spring.

9. The bushing according to claim 8 wherein means are provided for protecting the annular spring from impact from the bore contact.

10. In a high voltage bushing which is adapted to be mounted on an electrical device to provide electrical communication between operative components within said device and a probe in a high voltage cable terminator, the bushing comprising;

a housing, an electrical conductor extending through said housing, a gas actuated bore contact slidably disposed in said housing, and means on said conductor for maintaining a positive electrical connection between said conductor and the outside surface of said bore contact on movement of said contact with respect to said conductor.

11. The bushing according to claim 10 wherein said electrically connecting means comprises a spring.

12. The bushing according to claim 10 wherein said electrical connecting means comprises an annular compression spring having an inside diameter smaller than the diameter of said bore contact.

13. A high voltage bushing comprising;

a housing having an axially extending bore, an electrically conductive cylinder positioned in a fixed position in said bore and closing one end of said bore, an arc snuffer bore contact assembly slidably mounted in said bore and extending partially into said cylinder, said snuffer-contact assembly being movable in response to arc-generated gases in said housing, and spring means fixedly mounted in said cylinder for maintaining electrical engagement with the outside surface of said bore contact on movement of said bore contact relative to said cylinder.

14. The bushing according to claim 13 wherein said spring means comprises a compression spring.

15. An electrical connection comprising:

a cylindrical conductor, a bushing housing for supporting said conductor in a fixed position, a gas actuated bore contact mounted for reciprocal movement within said conductor and an annular compression spring mounted in said conductor and having an inside diameter smaller than the outside diameter of said bore contact for maintaining electrical communication between said contact and said conductor.

16. A high voltage bushing comprising:

a housing having an axially extending bore, an electrically conductive cylinder positioned in a fixed position in said bore and closing one end of said bore, an arc snuffer bore contact assembly slidably mounted in said bore and extending partially into said cylinder, said snuffer contact assembly being movable in response to arc generated gases in said housing, and a compression spring fixedly mounted in said cylinder for electrically engaging said bore contact, said spring being formed into a ring having an inside diameter smaller than the outside diameter of the bore contact.

* * * * *